US006261121B1

(12) United States Patent
Harting et al.

(10) Patent No.: US 6,261,121 B1
(45) Date of Patent: Jul. 17, 2001

(54) CABLE TERMINAL FOR MECHANICALLY RETAINING AND ELECTRICALLY CONNECTING A CABLE

(75) Inventors: Dietmar Harting, Espelkamp (DE); Jean François Bernat, Sartrouville; Jean Merri de Vanssay, Paris, both of (FR)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/513,026

(22) Filed: Feb. 25, 2000

(30) Foreign Application Priority Data

Feb. 26, 1999 (DE) ..... 199 08 455

(51) Int. Cl.[7] ..... H01R 13/58
(52) U.S. Cl. ..... 439/469; 174/65 R
(58) Field of Search ..... 439/460, 463, 439/469; 174/84 C, 65 R

(56) References Cited

U.S. PATENT DOCUMENTS 4,396,837 8/1983 Crouse et al. .
5,445,538 * 8/1995 Rodrigues et al. ..... 439/460
5,505,637 4/1996 Kramer et al. .
5,848,914 12/1998 Lang et al. .

FOREIGN PATENT DOCUMENTS 508 993 7/1971 (CH) .

* cited by examiner

*Primary Examiner*—Neil Abrams
(74) *Attorney, Agent, or Firm*—Cook, Alex, McFarron, Manzo, Cummings & Mehler, Ltd.

(57) ABSTRACT

A cable terminal for mechanically retaining and electrically connecting a cable comprises a two-piece housing having a first housing shell and a second housing shell, and a clamping device adapted to receive the cable. The clamping device defines a longitudinal axis and comprises at least two pairs of deforming elements arranged opposite each other. The deforming elements of a first of the pairs are arranged opposite each other in a clamping direction which is different from a clamping direction in which the deforming elements of a second of the pairs are arranged opposite each other. The first and the second pairs are arranged in sequence along the longitudinal axis.

16 Claims, 4 Drawing Sheets

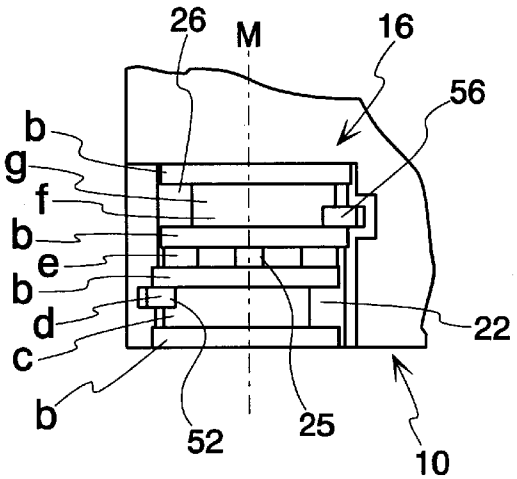
Fig. 2a
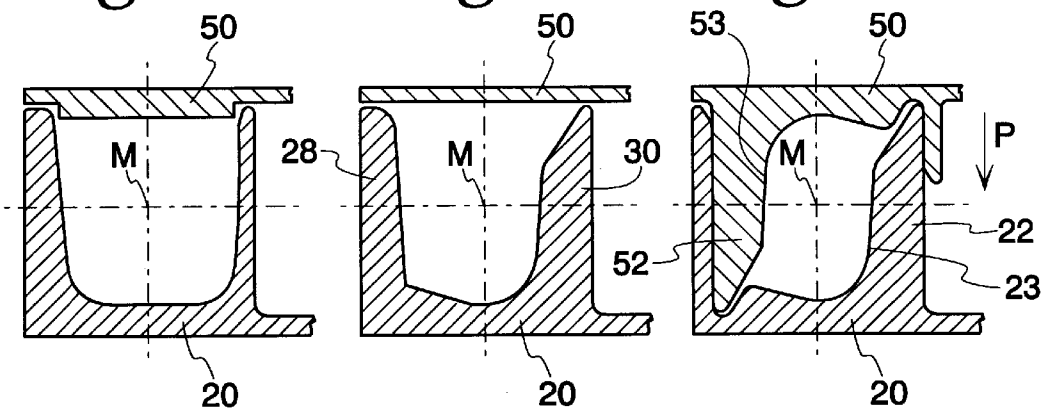
Fig. 2b
Fig. 2c
Fig. 2d
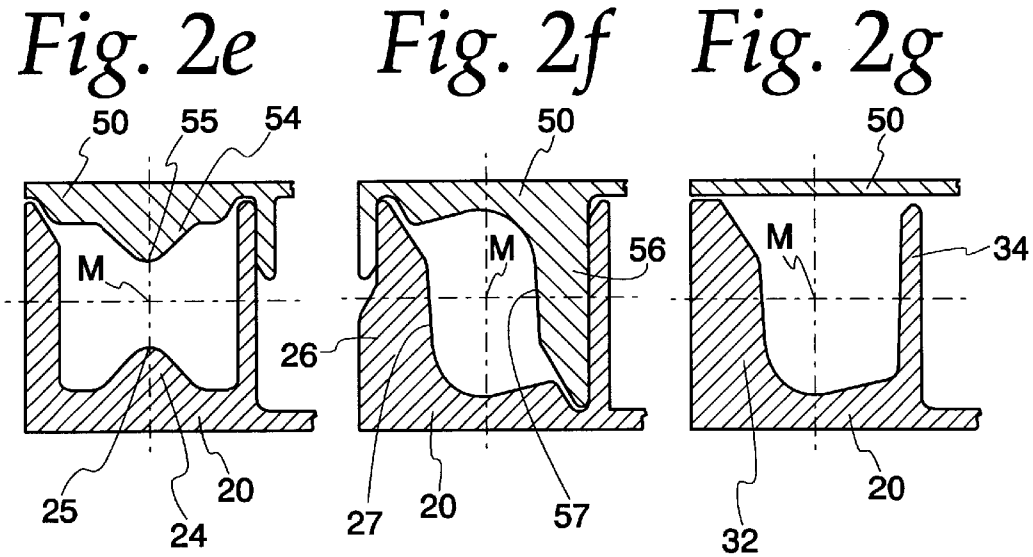
Fig. 2e
Fig. 2f
Fig. 2g

CABLE TERMINAL FOR MECHANICALLY RETAINING AND ELECTRICALLY CONNECTING A CABLE

TECHNICAL FIELD

The invention relates to a cable terminal for mechanically retaining and electrically connecting a cable, comprising a two-piece housing and a clamping device for a cable to be inserted into the housing.

BACKGROUND OF THE INVENTION

Such a cable terminal may be put to use, for example, in a switchboard cubicle where it needs to satisfy differing requirements. For one thing, it needs to permit a reliably good electrical connection of the cable. At the same time it is to provide strain relief by means of which the cable is retained in the cable terminal such that tensile strain introduced into the cable is not transferred to the electrical connection, it instead being directed away into the housing beforehand. Finally, such a cable terminal may also be made use of to provide electrical shielding of the cable joint with the electrical connection.

Known from prior art are two concepts by means of which it is attempted to ensure both a reliable mechanical retention of the cable in the cable terminal and good electrical shielding. One concept provides for configuring a cable receptacle provided with several screws which in the screwed-in condition engage the sheath of the cable. If the cable is provided with a shielding this can be folded back through 180° on the cable sheath and contacted there. Another concept provides for crimping a retaining ring onto the cable sheath. This ring is then inserted into an accommodating receptacle in the housing and acts as a strain relief. If the shielding is exposed prior to crimping the retaining ring and is folded back on the sheath the retaining ring is able to contact this shielding and serve together with the electrically conducting receptacle to ensure a good shielding of the cable terminal.

The drawback in these concepts is the high expenditure involved in inserting and securng the cable.

BRIEF SUMMARY OF THE INVENTION

The object of the invention consists of improving a cable terminal of the aforementioned kind so that a cable to be inserted into the cable terminal can be reliably mechanically retained with minimum complication.

This object is achieved in a cable terminal for mechanically retaining and electrically connecting a cable. The cable terminal comprises a two-piece housing having a first housing shell and a second housing shell, and a clamping device adapted to receive the cable. The clamping device defines a longitudinal axis and comprises at least two pairs of deforming elements arranged opposite each other. The deforming elements of a first of the pairs are arranged opposite each other in a clamping direction which is different from a clamping direction in which the deforming elements of a second of the pairs are arranged opposite each other. The first and the second pairs are arranged in sequence along the longitudinal axis. The term "clamping direction" is understood to be the direction along which the two deforming elements of a pair exert a clamping force on the inserted cable; this direction generally coinciding with the direction of the shortest connection between the two deforming elements.

Termed in general, the gist of the cable terminal in accordance with the invention is based on the retaining force to be made available for the purpose of strain relief being furnished by at least two pairs of deforming elements arranged in sequence. These deforming elements are configured such that the deformation of the cable caused by them differs directionally. When, for example, the first and the second pair of deforming elements deform the cable from its initial round cross-section into an oval cross-section the direction defined by the longer main axis of the oval cross-section in the region of the first pair of deforming elements differs from the direction defined by the longer main axis of the second oval cross-section. However, the resulting deformation must not necessarily result in an oval or elliptical cross-section of the cable. Depending on the configuration of the deforming elements and the deformation response of the cable, a constricted cross-section may also be produced, for instance. In any case a reduction in the diameter of the cross-section occurs in the clamping direction in which the deforming elements are arranged opposite each other, whilst at right angles to this clamping direction, for instance, an enlargement of the diameter of the cross-section materializes. Due to the differing orientation of the deformed cross-sections of the cable, any tendency of the cable to be pulled out from the cable terminal is counteracted by a resistance to a change in shape in addition to the friction forces produced at the "bite" locations of the deforming elements on the cable; namely, for the cable to be pulled out, each point of the cable deformed in a first direction by a pair of deforming elements would need to be deformed in another direction in the subsequent pair of deforming elements. It is this resistance to a change in shape resulting from the material stiffness of the cable that counteracts the multiple deformation of the cross-section.

In accordance with a preferred embodiment of the invention it is provided for that the clamping direction dictated by the first pair of deforming elements differs by roughly 90° from the clamping direction dictated by the second pair of deforming elements. This configuration produces a maximum resistance in the case of tensile forces acting on the cable.

In accordance with the preferred embodiment of the invention a third pair of deforming elements is provided, the second pair of deforming elements being disposed between the third pair of deforming elements and the first pair of deforming elements and the clamping direction dictated by the third pair of deforming elements roughly coinciding with the clamping direction dictated by the first pair of deforming elements. In this configuration three deformed cross-sections of the cable are produced, each of which differs from the adjacent cross-section to thus further enhance the strain relief effect.

It is preferably provided for that a deforming element of a pair is applied to the first housing shell and the associated other deforming element is applied to the second housing shell. In this configuration a minimum assembly requirement is involved, the cable merely needing to be inserted into the one of the housing shells. The strain relief then materializes automatically when the second housing shell is mounted and connected to the first housing shell.

In accordance with the preferred embodiment of the invention it is further provided for that a deforming element consists of a rib extending in a plane perpendicular to the longitudinal axis of the cable to be accommodated in the cable terminal. Using a rib as a deforming element offers various advantages. For one thing it is simple to manufacture, especially when the two housing shells are fabricated as injection molded parts. For another, the deformation of the cable and the thereby resulting resisting and retaining forces can be freely adjusted by the geometrical configuration of the rib, for example of the edge engaging the cable and the width of this edge.

It is, for example, possible that the rib engages the cable by a straight edge which, as regards a tangent to the outer circumference of the cable to be inserted, is slightly inclined. In this configuration inserting the cable is facilitated; apart from this the risk of the cable being damaged on insertion is reduced.

Preferably the two edges are opposite each other in a clamping direction which is roughly perpendicular to the direction in which the housing is closed. In this configuration the pushing forces needed to clamp the cable in place are applied on closing the housing. Since due to the wedge effect no particularly high forces are needed to close the housing, just a few screws are sufficient to reliably close the housing. Apart from this, no particular precautions are needed to prevent deformation of the housing.

As an alternative it is provided for that the rib engages the cable by a protuberance. This configuration results in a precisely defined contact zone between rib and cable so that even in the case of comparatively small compressive forces a high surface pressure and thus high friction can be achieved.

Preferably the protuberance comprises an apex engaging the cable. By selecting the radius of curvature of this apex, the ways and means by which the cable is deformed by the protuberance can be influenced. When, for example, the radius of curvature of the apex is smaller than the radius of the outer circumference of the cable to be inserted, a deformed cross-section materializes which, when the cable is readily deformable, roughly corresponds to an ellipse which in the region of its short half axes is strongly constricted, namely in the portion in which the apex of the rib engages. If, however, the cable is only slightly deformable, the apexes engaging the cable result in an oval cross-section.

Preferably it is provided for that the two protuberances are opposite each other in a clamping direction roughly coinciding with the direction in which the housing is closed. In this configuration the clamping effect is achieved by the ribs automatically when the housing is closed without any additional means needing to be provided.

In accordance with the preferred embodiment at least one U-shaped retaining section is provided, the space between the two legs of the retaining section being smaller than the outer diameter of the cable to be inserted. This retaining section serves to locate the cable in a housing shell before the other housing shell is fitted.

Preferably the retaining section is laterally offset relative to the pairs of deforming elements so that the cable to be inserted is deflected from the middle axis. The resulting lateral deflection of the cable enhances the retaining force provided by the strain relief.

In accordance with a preferred embodiment of the invention it is provided for that the pairs of deforming elements are electrically conductive and electrically conductively engage a shielding of the inserted cable, thus enabling an electrical shielding of the cable to be connected to a ground terminal without requiring an additional working step. Preferably also the housing is electrically conductive so that the electrical connection of the cable configured in the housing is likewise shielded. The electrical contact between the shielding of the cable and the electrically conductive pair of deforming elements can be achieved in two ways: one way is to configure the pairs of deforming elements as blades which bite through the sheath of the cable and engage the shielding of the cable so that it is contacted electrically conductive; another way is to expose the shielding of the cable prior to inserting it into the cable terminal and fold it back through 180° on to the sheath of the cable so that it lies on the outer circumference of the cable. In this arrangement the pairs of deforming elements then automatically engage the shielding whilst at the same time mechanically retaining the cable in the cable terminal.

Advantageous aspects of the invention read from the sub-claims.

BRIEF DESCRIPTION OF THE DRAWINGS

FIGS. 2*a* to 2*g* are cross-sections of the cable terminal in accordance with the invention in differing planes;

DETAILED DESCRIPTION OF THE INVENTION

Figure 1:
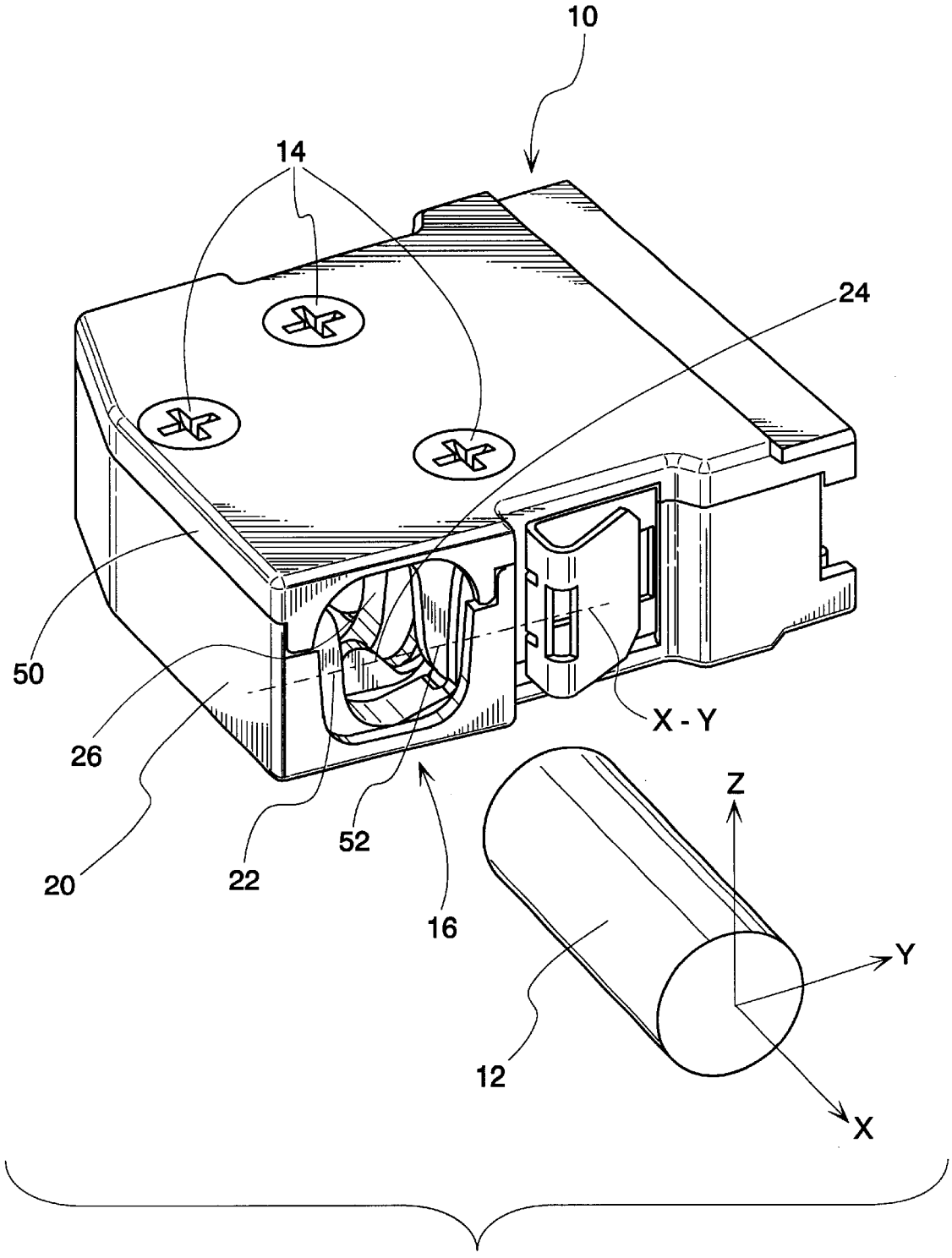
FIG. 1 is a perspective view of a cable terminal in accordance with the invention and a cable to be inserted therein.

Referring now to FIG. 1 there is illustrated a cable terminal 10 serving to mechanically retain and electrically connect an electrical cable 12.

The cable terminal 10 comprises a first housing shell 20 and a second housing shell 50. The second housing shell 50 can be mounted like a cover onto the first housing shell 12 and secured thereto by three screws 14. The two housing shells may be made of a plastics material and configured integrally, for example hinged to each other by a plastics film hinge.

The housing 10 is provided with a strain relief identified in general by the reference numeral 16. This strain relief consists of a first pair of deforming elements 22, 52, a second pair of deforming elements 24, 54 and a third pair of deforming elements 26, 56. The strain relief 16 will now be detailed with reference to the FIGS. 2 to 5.

Referring now to FIG. 2*a* there is illustrated schematically a section through the strain relief 16 taken along the plane X-Y (see FIG. 1). Shown in FIGS. 2*b* to 2*g* are cross-sections perpendicular to the axis X in the region of the strain relief 16, the respective plane being identified in FIG. 2*a*. For example, the illustration of the cross-section identified by the letter c in FIG. 2*a* is evident from FIG. 2*c*.

The strain relief 16 comprises on the outer side of the cable terminal 10 an input cross-section which is larger than the cross-section of the cable 12 to be accommodated. As evident from FIG. 3*b* the cable 12 passes freely through the input cross-section.

Adjoining the input cross-section in the plane c is a U-shaped retaining section formed by two legs 28, 30 provided on the first housing shell 20. The legs 28, 30 are located opposite each other at such a spacing that the originally circular cross-section of the cable 12 is slightly deformed into an oval cross-section. This is evident from FIG. 3*c* in which the original cross-section is depicted by a solid line and the deformed cross-section by the double-hatching. The two legs 28, 30 are laterally offset relative to a middle axis M which coincides with the X axis of the cable so that the cable 12 is deflected to one side.

Adjoining the retaining section arranged in the plane c are two deforming elements 22, 52 in the plane d. The deforming elements are configured as ribs, the rib 22 being provided on the first housing shell 20 whilst the rib 52 is provided on the second housing shell 50. The ribs comprise two straight edges 23, 53 provided to engage the cable 12 (see FIG. 3*d*). The two edges 23, 53 are located opposite each other in a clamping direction corresponding to the direction in which a clamping effect is exerted on the cable 12. Furthermore, the edges 23, 53 are arranged slightly inclined to the direction in which the two housing shells 20, 50 are joined together and which is symbolized by the arrow P in FIG. 2*d*, so that when the two housing shells 20, 50 are joined together an increasing wedge effect materializes. Despite the relatively low force needed to join the two housing shells 20, 50 together, this wedge effect enables a comparatively high clamping effect to be exerted on the cable 12 in the plane d. Accordingly, starting from its original circular cross-section the cable 12 is deformed into the marked elliptical cross-section, i.e. the clamping direction running roughly horizontal.

The edges 23, 53 merge into leading-in slopes towards the free ends of the ribs 22, 52, which slopes automatically position and center the cable in the pair of clamping elements 22, 52. Provided furthermore in the region of the free ends of the ribs 22, 52 are receptacles in the corresponding opposing housing shell so that the expanding forces occurring in deformation of the cable are safely and reliably handled to prevent deformation of the housing.

Adjoining the deforming elements 22, 52 is a section having the cross-section as shown in FIG. 2*b* in which the cable is able to regain its non-deformed circular cross-section.

Figure 3A:
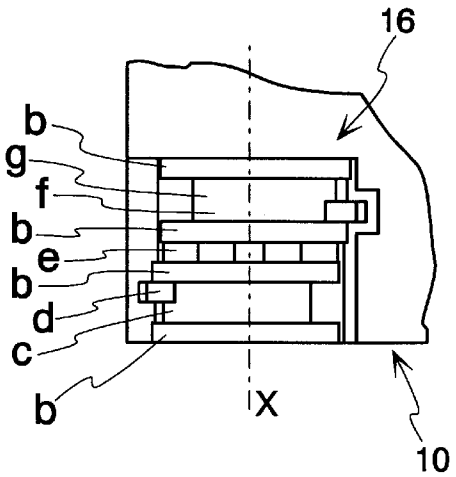
FIGS. 3*a* to 3*g* are cross-sections as shown in FIG. 2 with the cable inserted.
Figure 3B:
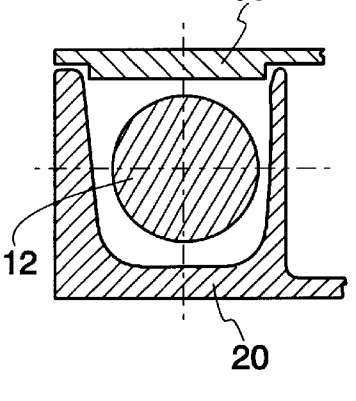
Figure 3C:
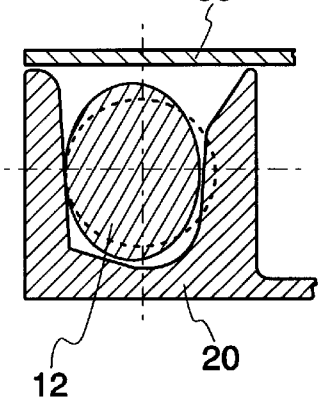
Figure 3D:
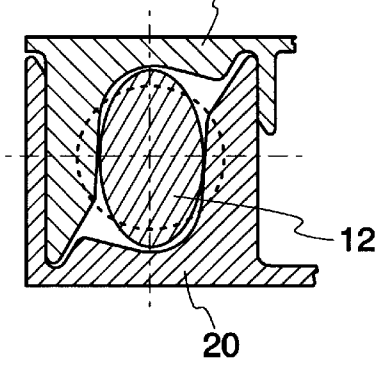
Figure 3E:
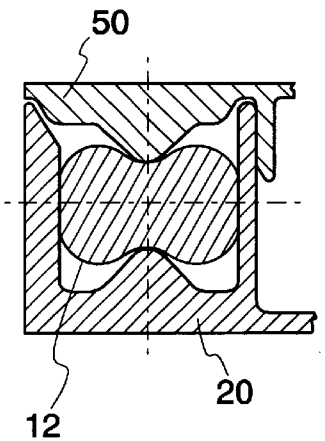
Figure 3F:
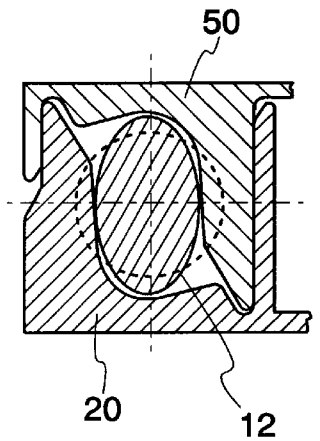
Figure 3G:
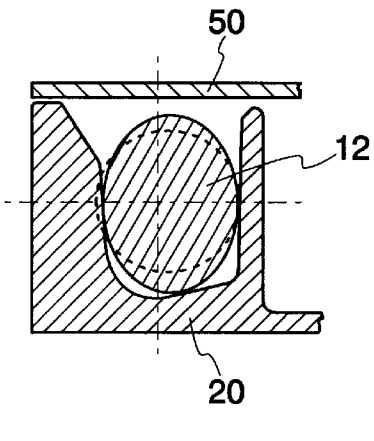
Figure 4:
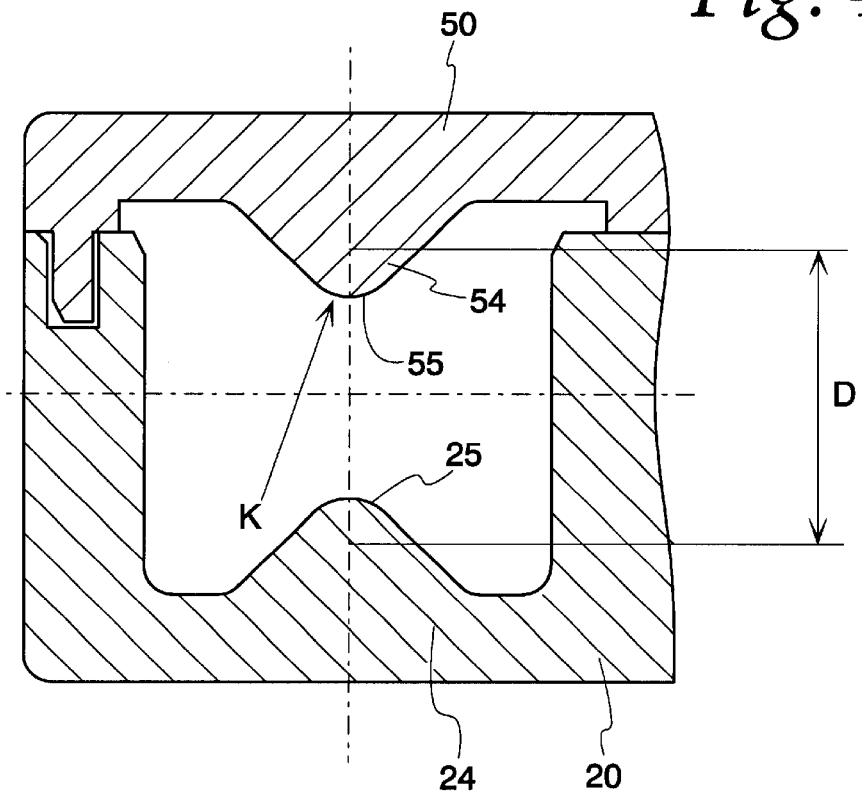
FIG. 4 is a cross-section as shown in FIG. 2*c* in an enlarged scale.

Arranged adjacent in the plane e is a second pair of deforming elements 24, 54. Unlike the first pair of deforming elements, rib-shaped protuberances are used in this case which engage the cable 12 to be accommodated by their apexes 25, 55. The radius of curvature r at the apex of the deforming elements 24, 54 (see also FIG. 4) is smaller than the radius of the outer circumference of the cable 12. This results in the originally circular cross-section of cables usually accommodated in the cable terminal 10 being deformed into the cross-section as shown in FIG. 3*c* which is generally an ellipse with a constriction in the region of the short half axes. Depending on the properties of the cable to be accommodated in each case, more particularly on the deformability of the cable sheath and outer diameter, other deformed cross-sections may materialize, however, for instance an elliptical cross-section with no constriction.

The first deforming element 24 is configured on the first housing shell 20 and the second deforming element 54 on the second housing shell 50. Provided furthermore on the second housing shell 50 is a receptacle for a rib laterally limiting the deformed cross-section e in extending from the first housing shell 20. It is in this way that the clamping force between the apexes 25, 55 automatically materializes when the two housing shells 20, 50 are joined together, this receptacle for the rib extending from the first housing shell 20 ensuring precise positioning of the two housing shells relative to each other.

Adjoining the second pair of deforming elements in turn is a section, as evident from FIG. 2*b*, in which the cable to be accommodated has a circular cross-section.

Figure 5:
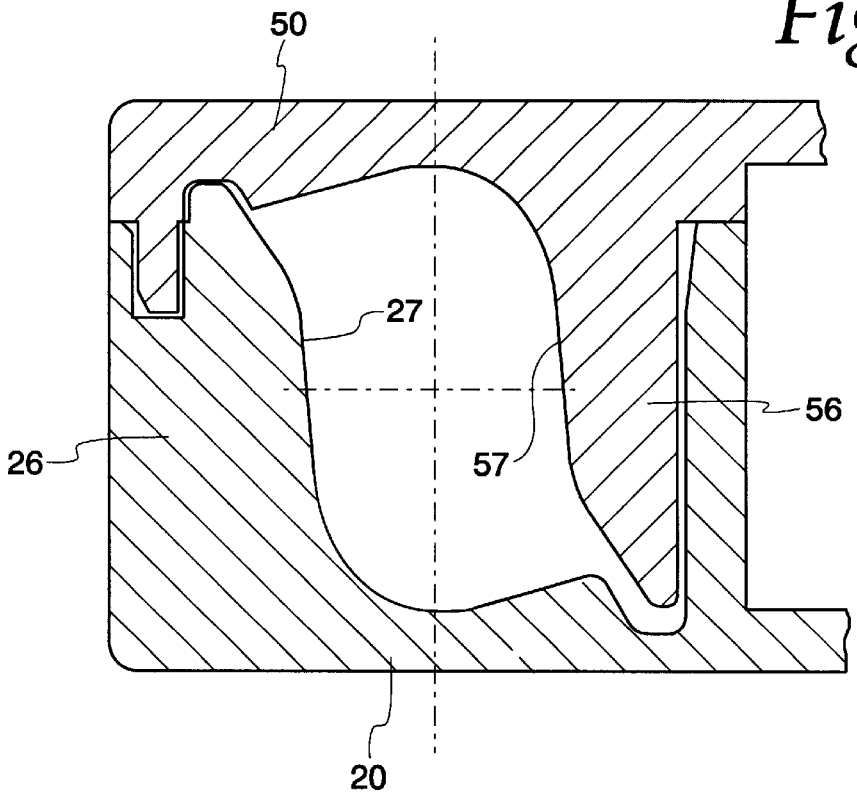
FIG. 5 is a cross-section as shown in FIG. 2*f* in an enlarged scale.

Provided subsequently in the plane f is a third pair of deforming elements, the ribs 26, 56 provided in this case corresponding to the ribs 22, 52 known from plane d, except that in this case the ribs are arranged the other way round, i.e. rib 26 engaging the left-hand side of the cable as shown in FIG. 2 is now configured integrally with the first housing shell 20, whilst rib 56 engaging the right-hand side of the cable is configured on the second housing shell 50. It is in this way that the force acting overall on the second housing shell along the axis Y is zero, since the compressive force exerted on the rib 52 is roughly the same as the compressive force exerted on the rib 56. Referring now to FIG. 5 there is illustrated that the free end of the rib 26 is received by the second housing shell 50 and the free end of the rib 56 is accommodated in a receptacle on the first housing shell 20.

Arranged subsequently in the plane g is a retaining section as known in principle from the plane c. The two legs 32, 34 define a cross-section which relative to the middle axis M is offset in the opposing direction the same as in plane c.

Arranged directed towards the interior of the housing is a further cross-section as is known from plane b, the cable thus comprising its circular cross-section.

It is due to this sequence of pairs of deforming elements that the following sequence of differing cable cross-sections materializes when viewed in the negative X direction of the cable: in entering the cable terminal 10 the cable has a round cross-section, before then being deformed into an oval cross-section whose longer half axes are oriented in the Z direction since the clamping direction is oriented roughly along the Y axis. This is followed by the cable being deformed into a constricted elliptical cross-section, in which the longer half axes of the ellipse are oriented in the Y direction since the clamping direction is oriented along the Z axis. Subsequently the cable is again deformed into an elliptical cross-section whose longer half axes are oriented in the Z direction. Finally, the cable in the interior of the cable terminal again has its circular cross-section. In addition the cable is deflected from the middle axis M in the region of the retaining sections located in the planes c and g. Due to this configuration a very high retaining force materializes despite the relatively low compressive forces need to be applied in joining the two housing shells 20, 50 together which in turn enables only relatively few screws or comparable other elements to be used in connecting the two housing shells to each other. In addition, there is now no need for any complicated stiffening of the housing and it does not need to be fabricated particularly solid since only slight clamping forces are to be applied by the screws and are to be directed to the corresponding locations of the housing. Depending on the dimensions in each case and the cable accommodated, retaining forces of up to 100 N are achievable. Due to the relatively low compressive forces to be exerted on the cable to achieve the desired retaining forces, any settling of the cable, especially of the sheath, now plays a much less significant role than in prior art cable terminals which need to make use of very much higher compressive forces.

When a shielded cable terminal is used in conjunction with a shielded cable, the deforming elements in the plane e may be made use of together with those of plane d and/or plane f to electrically contact the shielding of the cable. Since in this way the shielding is contacted in all at at least four points arranged at right angles to each other with a slight offset in the X-direction, contacting the shielding is qualitatively practically the same as a contacting obtained by a clamp clasping the shielding through a full 360°, for example.

What is claimed is:

1. A cable terminal for mechanically retaining and electrically connecting a cable, comprising a two-piece housing having a first housing shell and a second housing shell, and a clamping device adapted to receive said cable and defining a longitudinal axis, said clamping device comprising at least two pairs of deforming elements, within each of said pairs, said deforming elements are arranged opposite each other forming a clamping direction, said deforming elements of a first of said pairs being arranged opposite each other in a clamping direction which is different from a clamping direction in which said deforming elements of a second of said pairs are arranged opposite each other, said first and said second pairs being arranged in sequence along said longitudinal axis.

2. The cable terminal of claim 1, wherein said clamping direction dictated by said first pair of deforming elements differs by roughly 90° from said clamping direction dictated by said second pair of deforming elements.

3. The cable terminal of claim 1, wherein a third pair of deforming elements is provided which is disposed such that said second pair of deforming elements is disposed between said third pair of deforming elements and said first pair of deforming elements, said third pair of deforming elements dictating a clamping direction which roughly coincides with said clamping direction dictated by said first pair of deforming elements.

4. The cable terminal of claim 1, wherein one of said deforming element of one of said pairs is arranged at said first housing shell and the other of said deforming elements of one of said pairs is arranged at said second housing shell.

5. The cable terminal of claim 1, wherein at least one of said deforming elements consists of a rib extending in a plane perpendicular to said longitudinal axis of said clamping device.

6. The cable terminal of claim 5, wherein said rib engages said cable by a straight edge which, as regards a tangent to an outer circumference of said cable to be inserted, is slightly inclined.

7. The cable terminal of claim 6, wherein said straight edge is provided with a leading-in slope at one end.

8. The cable terminal of claim 6, wherein two edges are provided which are arranged opposite each other in a clamping direction which is roughly perpendicular to a direction in which said housing is closed.

9. The cable terminal of claim 5, wherein said rib is provided with a protuberance adapted to engage said cable to be inserted into said housing.

10. The cable terminal of claim 9, wherein said protuberance comprises an apex.

11. The cable terminal of claim 10, wherein a radius of curvature of said apex is smaller than the radius of an outer circumference of said cable to be inserted into said housing.

12. The cable terminal of in claim 9, wherein two ribs are provided which each feature said protuberance, a clamping direction defined by said protuberances roughly coinciding with a direction in which said housing is closed.

13. The cable terminal of claim 1, wherein at least one U-shaped retaining section having two legs is provided, a space between said two legs of said retaining section being smaller than an outer diameter of said cable to be inserted.

14. The cable terminal of claim 13, wherein said retaining section is laterally offset relative to said pairs of deforming elements so that said cable to be inserted is deflected from said longitudinal axis.

15. The cable terminal of claim 1, wherein said pairs of deforming elements are electrically conductive and adapted to electrically conductively engage at a shielding of said cable to be inserted into said housing.

16. The cable terminal of claim 15, wherein said two housing shells are electrically conductive.

* * * * *